US005775031A

United States Patent [19]

Levy

[11] Patent Number: 5,775,031

[45] Date of Patent: Jul. 7, 1998

[54] TEMPORARY COVER FOR EXCAVATIONS

[75] Inventor: Raymonde Maxwell Levy, Leeds, Great Britain

[73] Assignee: British Gas plc, London, Great Britain

[21] Appl. No.: 628,017

[22] Filed: Apr. 4, 1996

[30] Foreign Application Priority Data

Apr. 4, 1995 [GB] United Kingdom ..... 9506922

[51] Int. Cl.[6] ..... B62D 63/04

[52] U.S. Cl. ..... 52/3; 52/4

[58] Field of Search ..... 52/3, 4, 19, 20, 52/21; 404/25, 26

[56] References Cited

U.S. PATENT DOCUMENTS 1,439,226 12/1922 Clarke ..... 52/4

4,974,992 12/1990 Harter ..... 404/25

*Primary Examiner*—Creighton Smith

*Attorney, Agent, or Firm*—William R. Hinds

[57] ABSTRACT

A temporary cover for excavations comprising a platform having a lowermost surface for contact with the ground surrounding the excavation and an uppermost surface and means attached to the platform for securing the platform to a below ground anchor point.

13 Claims, 3 Drawing Sheets

TEMPORARY COVER FOR EXCAVATIONS

The present invention relates to a temporary cover for excavations.

According to the present invention we provide a temporary cover for excavations, comprising a platform having a lowermost surface for contact with the ground surrounding the excavation and an uppermost surface and means attached to the platform for securing the platform to a below ground anchor point.

Preferably the means for securing the platform to the anchor point is a rope, which preferably is non biodegradable, such as nylon.

The anchor point may be a pipeline, prop or piece of scrap pipe.

Figure 1:
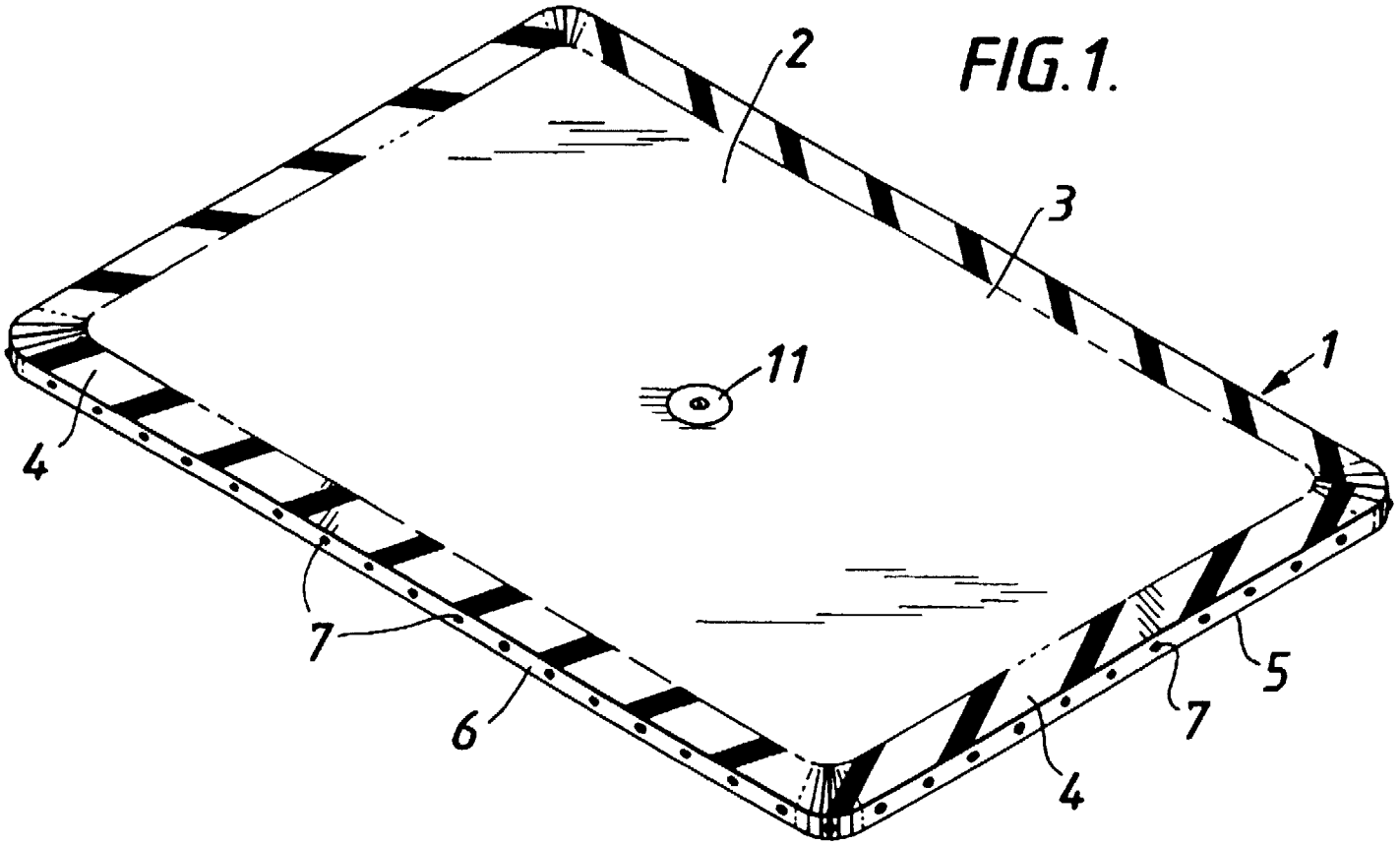
Figure 2:
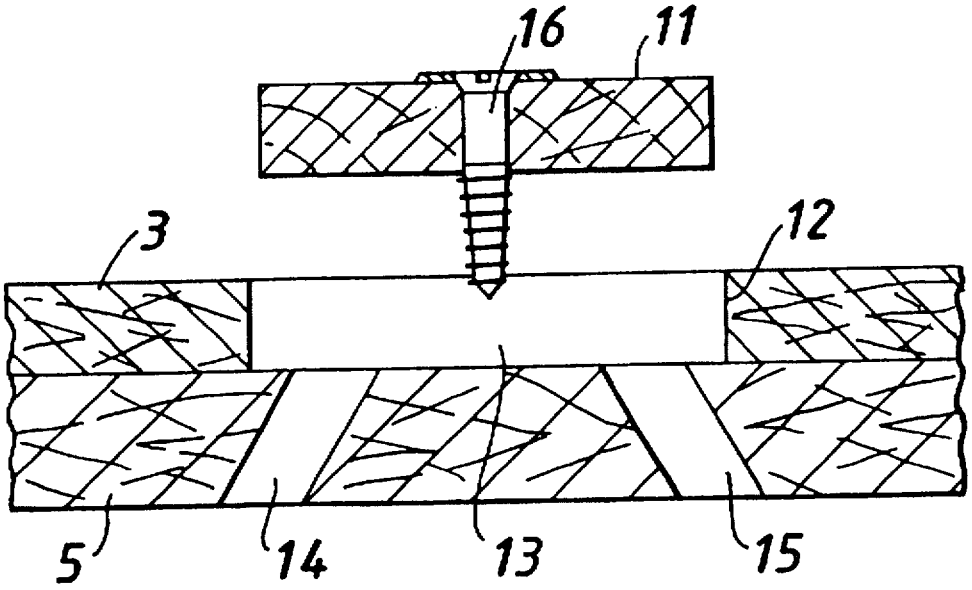
Figure 3:
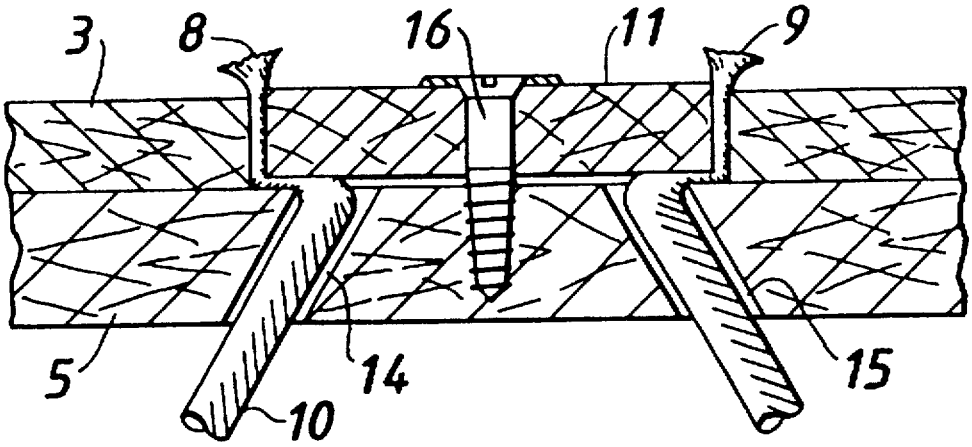
Figure 4:
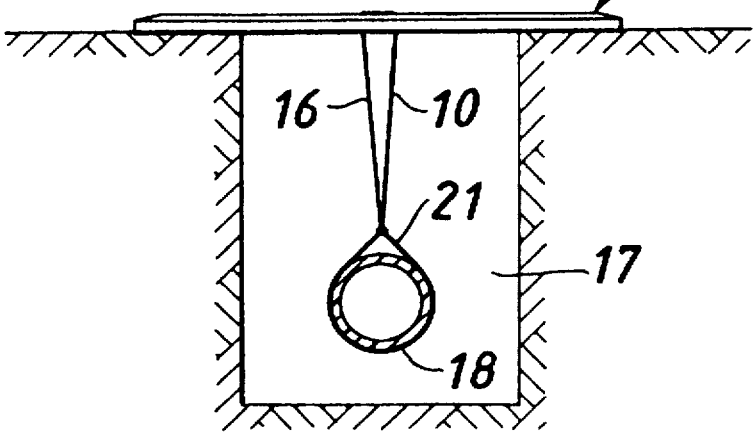
Figure 5:
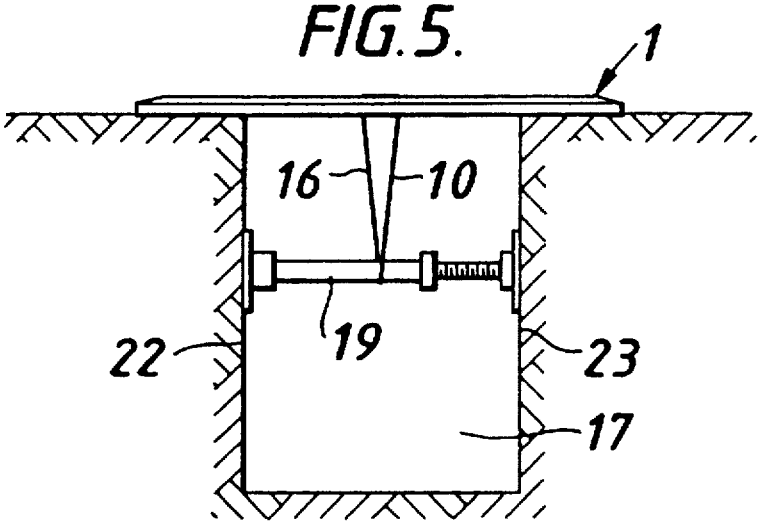
Figure 6:
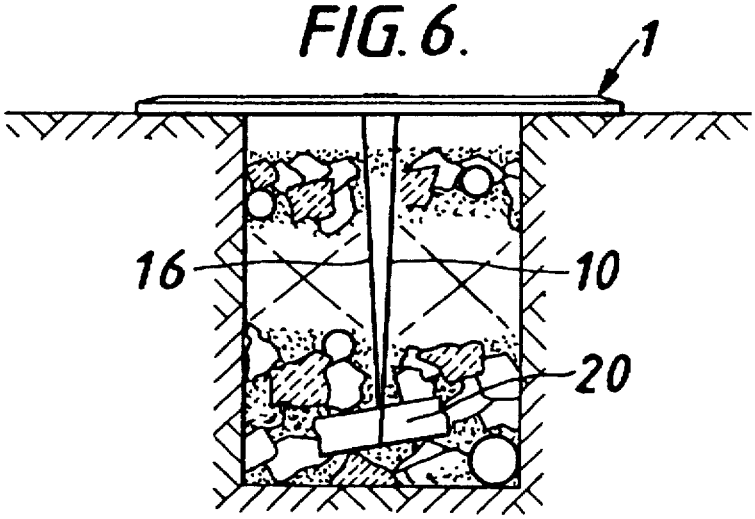

An embodiment of the invention will now be particularly described with reference to the drawings in which FIG. 1 is a view from above and generally from one corner of the platform, FIGS. 2 and 3 are longitudinal sections through the centre of the cover showing in sequence how a rope is clamped to the platform, FIG. 4 shows the platform anchored to a pipeline extending through the excavation, FIG. 5 shows the platform anchored to a prop held by the walls of the excavation and FIG. 6 shows the platform anchored to a piece of scrap pipe.

Referring to the drawings, and in particular FIG. 1, the platform 1 is constructed of marine plywood. The surface 2 is coated with a non-slip material made by mixing shot-blasting grit and synthetic enamel in high visibility yellow 08E51 Goldcup. The platform 1 comprises an uppermost section 3 having 30 degrees chamfered edge 4 which is highlighted by a black chevron markings warning of the difference in levels, and a lowermost section 5 around the edge of which extends a protective rubber impact trim 6 which is attached to the section 5 by 30 mm power staples 7. The two sections 3 and 5 are nailed or glued together.

As shown in FIGS. 2 and 3, the two ends 8 and 9 of a rope 10 (see also FIGS. 4 to 6) are clamped to the uppermost section 3 of the platform 1 by means of a circular plug 11 and the adjacent circular wall 12 of the cavity 13 formed in the section 3 by the removal of the plug piece 11. In use, the ends 8 and 9 of the rope 10 respectively extend into the cavity 13 via two channels 14 and 15 formed in the lowermost section 5.

When placed above an excavation or pit 17 such as any of those shown in FIGS. 4 and 6, the rope 10 which is in tension may be attached to any suitable anchor point such as a pipeline 18 as in FIG. 4, a screw prop 19 as in FIG. 5 or a piece of scrap pipe 20 as shown in FIG. 6. (The pipe is of a material which is non-biodegradable, such as polyethylene or nylon).

Regarding the pipeline 18, here it will be necessary to loop the rope 10 to a rope 21 tied around the pipeline 18 prior to bringing the rope ends 8 and 9 up through the cover channels 14 and 15. This is shown in FIG. 4. Alternatively the rope 10 can simply be looped around the pipeline 18.

In FIG. 5, the prop 19 is a screw-type prop which is jacked against opposite walls 22, 23 of the excavation 17 with rope looped around the prop 19.

In FIG. 6 the rope 10 is attached to a piece of non-biodegradable scrap pipe 20, e.g. polyethylene, which is buried in the excavation when this is filled in as shown in FIG. 6.

In all cases after attaching the rope 10 to the anchoring device, the ends 8 and 9 of the rope 10 are drawn upwardly and inserted into their respective channels 14 and 15 in section 5. The ends 8 and 9 are then pulled tightly through the channels 14 and 15 so that the rope 10 is in tension and while retaining that tension, the plug 11 is screwed to the section 5 to clamp the ends 8 and 9 of the rope 10 to the walls 12 of the cavity 13 in section 3.

The platform described above when anchored cannot shift and move laterally across the top of the excavation and is therefore safer for walking on than the conventional cover or platform laid across the excavation. It can allow people to safely walk or cycle over excavations in pavements, pathways and driveways crossing footways. It can also, of course, keep rain and snow out from the excavation.

I claim:

1. A temporary cover for excavations in the ground, comprising a platform having a lowermost surface for contact with the ground surface surrounding the excavation, and having an uppermost surface, and flexible means attached to and depending solely from the lowermost surface of the platform for facilitating securing the platform to a below ground anchor point.

2. A cover as claimed in claim 1 in which the means for securing the platform to the anchor point is a rope.

3. A cover as claimed in claim 1 in which the anchor point is a pipeline.

4. A cover as claimed in claim 1 in which the anchor point is a prop.

5. A cover as claimed in claim 1 in which the anchor point is a piece of scrap pipe.

6. A cover as claimed in claim 2 in which the anchor point is a pipeline.

7. A cover as claimed in claim 2 in which the anchor point is a prop.

8. A cover as claimed in claim 2 in which the anchor point is a piece of scrap pipe.

9. A temporary cover for excavations in the ground, comprising a platform having a lowermost surface for contact with the ground surface surrounding the excavation, and having an uppermost surface, and flexible means attached to the platform for securing the platform to a below ground anchor point, said flexible means comprising a rope-like member adjustably clamped to said platform and depending from the lowermost surface thereof.

10. A cover as claimed in claim 9 wherein the clamped part or parts of said member are disposed below and clear of the uppermost surface of said platform.

11. A cover as claimed in claim 10 wherein said member is adjustably clamped between two separable parts of said platform.

12. A cover as claimed in claim 11 wherein one of said parts is a plug which fits into a mating cavity formed in the other of said parts, said cavity opening into the uppermost portion of said platform such that said plug can be inserted and removed from above said platform, said other of said parts being formed with at least one passage connecting said cavity with the lowermost surface of said platform such that a part of said member may extend through said passage into said cavity to be clamped between said plug and a wall of the cavity.

13. A cover as claimed in claim 12 wherein said plug is removably secured in place in said cavity via a screw-threaded member.

* * * * *